US010573483B2

(12) United States Patent
Woodman et al.

(10) Patent No.: US 10,573,483 B2
(45) Date of Patent: Feb. 25, 2020

(54) MULTI-GRID ELECTRON GUN WITH SINGLE GRID SUPPLY

(71) Applicant: Varex Imaging Corporation, Salt Lake City, UT (US)

(72) Inventors: Colton B. Woodman, Magna, UT (US); Brad Canfield, Orem, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 150 days.

(21) Appl. No.: 15/694,657

(22) Filed: Sep. 1, 2017

(65) Prior Publication Data

US 2019/0074154 A1 Mar. 7, 2019

(51) Int. Cl.

| | |
|---|---|
| ***H01J 35/14*** | (2006.01) |
| ***H01J 29/48*** | (2006.01) |
| ***H01J 29/96*** | (2006.01) |
| ***H01J 29/62*** | (2006.01) |
| *H05G 1/08* | (2006.01) |

(52) U.S. Cl.

CPC ..... *H01J 29/96* (2013.01); *H01J 29/48* (2013.01); *H01J 29/62* (2013.01); *H01J 35/14* (2013.01); *H05G 1/085* (2013.01)

(58) Field of Classification Search

CPC .. H01J 29/48; H01J 29/62; H01J 29/96; H01J 35/045; H01J 35/14; H05G 1/085

See application file for complete search history.

(56) References Cited

U.S. PATENT DOCUMENTS

| | | | | |
|---|---|---|---|---|
| 5,857,887 | A * | 1/1999 | Gotoh | H01J 9/18 445/34 |
| 6,133,683 | A | 10/2000 | Enomoto | |
| 6,608,435 | B1 * | 8/2003 | Kimiya | H01J 29/503 313/412 |
| 6,807,248 | B2 | 10/2004 | Mihara | |
| 7,512,215 | B2 * | 3/2009 | Morton | H01J 35/04 378/10 |
| 2001/0010450 | A1 * | 8/2001 | Irikura | H01J 29/92 315/169.3 |
| 2004/0195583 | A1 | 10/2004 | Kaminga | |
| 2005/0023953 | A1 * | 2/2005 | Kimiya | H01J 29/48 313/441 |
| 2006/0125368 | A1 | 6/2006 | Hwu | |
| 2011/0080992 | A1 | 4/2011 | Dafni | |
| 2016/0217965 | A1 * | 7/2016 | Canfield | H01J 35/045 |
| 2017/0162359 | A1 * | 6/2017 | Tang | H01J 35/065 |

OTHER PUBLICATIONS

Search Report mailed in PCT/US2018/058274 dated Apr. 1, 2019.
Written Opinion mailed in PCT/US2018/058274 dated Apr. 1, 2019.

* cited by examiner

*Primary Examiner* — Mark R Gaworecki
(74) *Attorney, Agent, or Firm* — Laurence & Phillips IP Law

(57) ABSTRACT

Some embodiments include a system, comprising: a high voltage enclosure; a cathode disposed in the high voltage enclosure; an anode disposed in the high voltage enclosure; a plurality of grids disposed in the high voltage enclosure between the cathode and the anode; a voltage source configured to generate a common grid voltage; and a voltage divider disposed in the high voltage enclosure, configured to generate a plurality of grid voltages based on the common grid voltage, and configured to apply at least two of the grid voltages to the grids.

21 Claims, 11 Drawing Sheets

MULTI-GRID ELECTRON GUN WITH SINGLE GRID SUPPLY

BACKGROUND

This disclosure relates to multi-grid electron guns and systems with a single grid supply.

Multi-grid electron guns have multiple grids to control the flow of electrons. The multiple grids allow for particular beam shaping and relatively fast response time for beam current modulation and cutoff. In such multi-grid electron guns, the voltages applied to the grids may be different. Separate grid voltage sources are used to generate each of the different grid voltages. These voltages are generated outside of a high voltage enclosure of the electron gun and must be supplied to the grids through one or more high voltage cables and high voltage feedthroughs.

Multi-grid electron guns have a variety of applications. In one example, a multi-grid electron gun is used as part of an x-ray source for a computerized tomography (CT) scanner. In general, the grid voltage sources are mounted on a gantry of the CT scanner. However, the space on these gantries is limited. Each additional grid voltage source requires additional space on the gantry.

DETAILED DESCRIPTION

X-ray sources may include electron guns designed to create a beam of electrons. The electron beam is directed towards an anode that emits x-rays based on the incident electrons. One or more grids in an electron gun may be used to regulate and shape the electron beam.

In a particular example, a multi-grid electron gun may have two or more grids. These grids allow for relatively fast changes in the electron beam and, consequently, the x-ray emissions. Grid voltage sources are used to generate these voltages.

One or more of the grids may use a different voltage. As a result, a different grid voltage source may be used. However, additional grid voltage source may need additional space that is unavailable in some applications. For example, in computerized tomography (CT) scanning, the x-ray source, detector, power converters, and other components may be mounted on a gantry that rotates around a specimen. As will be descried in further detail below, space may be limited on the CT gantry. Space available for additional grid voltage sources may limit the number of grids that may be used, limiting the control of the electron beam.

In addition, x-ray sources may be used in medical imaging, allowing for non-invasively viewing the internal structure and functioning of organisms. The penetrating power of x-rays makes them invaluable for such applications, but over exposure to the x-rays can harm a patient or provide additional health risks. However, improved control over the electron beam may enable an operator to reduce the patient dose by not only turning the beam on/off but by commanding different current levels in a modulated sense. As will be described in further detail below, in some embodiments, control of a single common grid voltage may be used to adjust the beam current over an operating range.

Figure 1A:
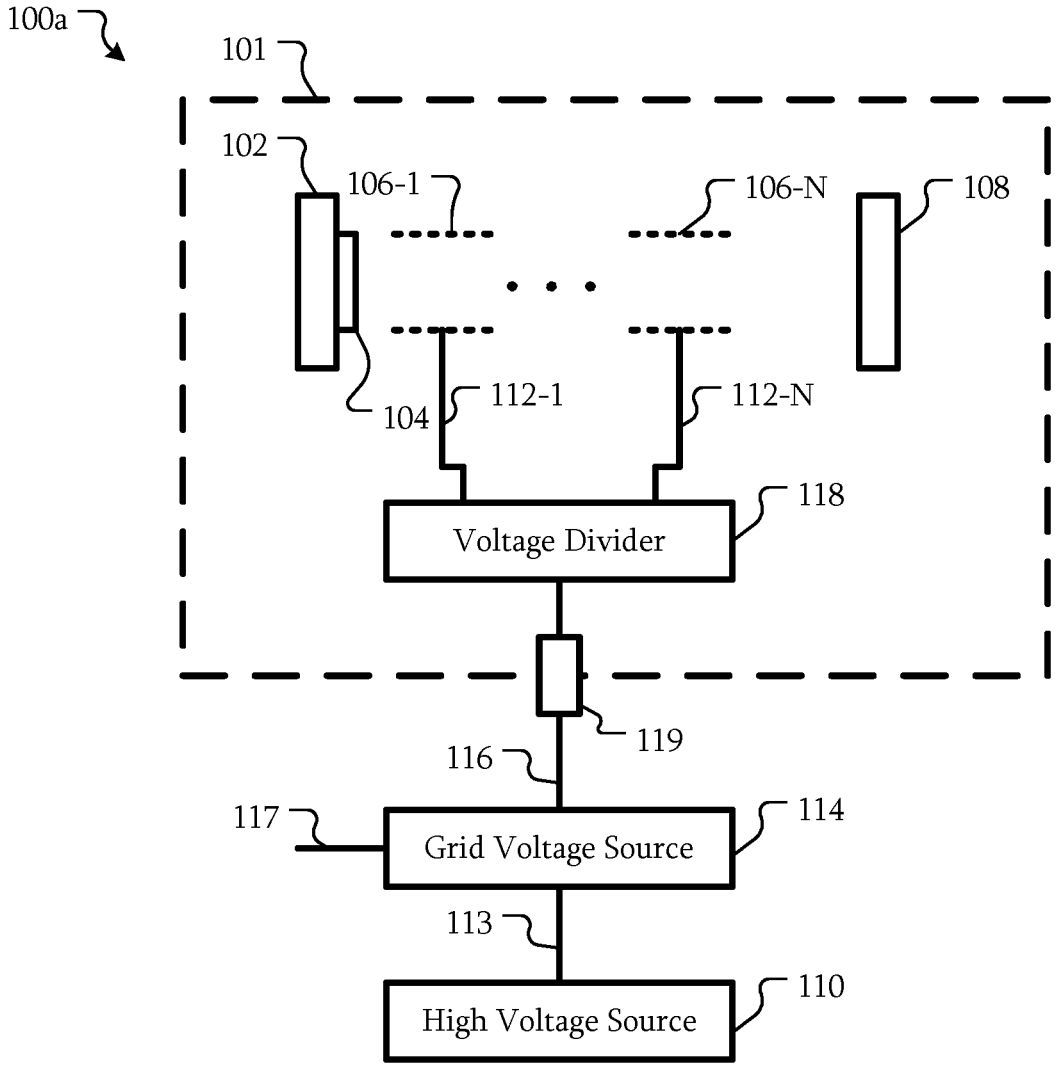
FIGS. 1A-1I are block diagrams of electron guns according to some embodiments.

FIGS. 1A-1I are block diagrams of electron guns according to some embodiments. Referring to FIG. 1A, in some embodiments, an electron gun 100*a* includes a high voltage enclosure 101. The high voltage enclosure is an enclosure that isolates exposed components operating at relatively high voltages. In some embodiments, the high voltage enclosure may include a vacuum enclosure.

A cathode 102 including an emitter 104 is disposed in the high voltage enclosure. The emitter 104 may be a variety of emitters. For example, the emitter 104 may be a bulk emitter, planar emitter, a filament, or the like. An anode 108 is disposed in the high voltage enclosure opposite to the cathode 102. The cathode 102, emitter 104, and anode 108 are illustrated conceptually. These components may have a variety of different structural configurations.

Multiple grids 106 are disposed in the high voltage enclosure between the cathode 102 and the anode 108. N grids are illustrated where N is any integer greater than 1. The grids 106 are configured to affect the flow of electrons from the emitter 104 to the anode 108.

A high voltage source 110 is disposed outside of the high voltage enclosure 101. The high voltage source 110 is configured to convert a power source into a high voltage 113. The high voltage source 110 may be configured to generate a variety of different voltages for the electron gun 100*a* such as a cathode voltage, an anode voltage, a heater voltage, or the like. For clarity, the supply of these voltages to the corresponding components of the electron gun 100*a* are not illustrated.

In some embodiments, the high voltage source 110 may be configured to receive an alternating current (AC) voltage and convert the AC voltage into a direct current (DC) voltage. In other embodiments, the high voltage source 110 may be configured to convert a DC voltage into the high voltage 113. Such a high voltage may be a voltage between 60 kV and 150 kV; however, in other embodiments, the high voltage 113 may be different.

The high voltage 113 may be used by the grid voltage source 114 to generate a common grid voltage 116. The common grid voltage 116 may be a voltage that is the same or different from the high voltage 113. In some embodiments, the common grid voltage may be a voltage between 0 and 75 kV; however, in other embodiments, the common grid voltage 116 may be different.

In some embodiments, the grid voltage source 114 may be a variable voltage source. For example, the grid voltage source 114 may be configured to receive a control input 117. The control input 117 may be a control signal from a controller for a system including the electron gun 100*a*; however, in other embodiments, the control input 117 may be generated by a different source. The grid voltage source 114 may be configured to change the voltage of the common grid voltage 116 in response to the control input 117.

In some embodiments, the grid voltage source 114 may be configured to continuously vary the common grid voltage 116. In other embodiments, the grid voltage source 114 may be configured to vary the common grid voltage 116 in steps. In other embodiments, the grid voltage source 114 may be configured to switch between two states, one to enable the electron beam and another to disable the electron beam.

A voltage divider 118 is disposed in the high voltage enclosure 101. The common grid voltage 116 may pass through the high voltage enclosure 101 through a feedthrough 119. In some embodiments, other voltages such as a cathode, anode voltage, another grid voltage, a heater voltage, or the like may pass through on another conductor of the feedthrough 119.

The voltage divider 118 is configured to generate multiple grid voltages 112 based on the common grid voltage 116. The voltage divider 118 is configured to apply at least two of the grid voltages 112 to the grids 106. In some embodiments, the voltage divider 118 may be configured to generate a different voltage for each of the grids 106; however, as will be described in further detail below, the association of grids 106 to grid voltages 112 may be different.

Accordingly, the electron gun 100*a* has multiple grids, but only a single common grid voltage 116 from a single grid voltage source 114. However, from this single common grid voltage 116, multiple different grid voltages 112 may be generated. In some embodiments, one or more of the grid voltages 112 may be a ratio of the common grid voltage 116. In a particular example, the electron gun 100*a* may have four grids (N=4). The ratio of the common grid voltage 116 to individual grid voltages 112 may be 0, 1:1, 2:1, and 0. That is, for a common grid voltage of 10 kV, grid voltages 112-1 to 112-4 may be 0 kV, 10 kV, 5 kV, and 0 kV, respectively. However, as described above, the common grid voltage 116 may be variable. Accordingly, if the common grid voltage 116 is changed to 5 kV, the grid voltages 112-1 to 112-4 may be changed to 0 kV, 5 kV, 2.5 kV, and 0 kV, respectively. Although particular ratios have been used as examples, in other embodiments, different ratios may be used.

In some embodiments, a number of high voltages that are supplied to the electron gun 100*a* through a high voltage cable and/or the feedthrough 119 may be reduced. As the multiple grid voltages 112 are generated by the voltage divider 118 within the high voltage enclosure 101, the multiple grid voltages 112 need not pass through a high voltage cable or pass through the feedthrough 119 of the electron gun 100*a*. As a result, the size of cables and the number of penetrations of the high voltage enclosure 101 may be reduced.

In some embodiments, the geometry of the grids 106 and other components of the electron gun 100*a* may be designed to operate using voltages that are ratios of common grid voltage 116 over an operating range. Accordingly, the operation of the electron gun 100*a* may be controlled by changing the common grid voltage 116. Changing the common grid voltage 116 results in grid voltages 112 that change according to the particular ratios. With grids 106 designed to operate using grid voltages 112 that are ratios of a common grid voltage 116, a single control may be used to adjust the electron beam. In contrast, with multiple grid voltage supplies, each voltage supply would need to be adjusted individually to achieve a desired output. Accordingly, a laminar beam may be formed with a variable beam current over a particular operating range.

In some embodiments, the grid voltages 112 may be selected to create an Einzel lens. For example, as described above, the grid voltages 112 may be 0 kV, 10 kV, 5 kV, and 0 kV. The first grid 106-1 may focus the electron beam towards a focal point. The remaining grids 106-2 to 106-4 may defocus the beam and subsequently focus it into a laminar beam.

Although not illustrated, in some embodiments, the electron gun 100*a* may still be used in conjunction with magnetic components configured to manipulate the electron beam. Magnetic manipulation of the beam may occur further from the emitter 104 than manipulation by the grids 106. Some manipulation of the electron beam may be performed by the grids 106 while other manipulation may be performed by the magnetic components. In a particular embodiment, the input to the magnetic control elements may now be a controllable laminar electron beam.

Although a particular sequence of grid voltages 112 and particular grid voltages 112 have been used as examples, in other embodiments, the sequence and grid voltages 112 may be different. As will be described in further detail below, grid voltages 112 may be reference voltages that do not change with the common grid voltage 116. Multiple grids may use the same grid voltage 112 from the voltage divider 118. The grid voltages 112 may have an order matching or differing from the order of the grids 106. Multiple grid voltage sources 114 may be used to generate the grid voltages 112 with at least one grid voltage source 114 generating a common grid voltage 116 from which at least two grid voltages 112 are generated.

In addition, the voltages described herein may be different according to the configuration of the electron gun, such as a configuration having a grounded anode, grounded cathode, or the like. For example, a voltage of 10 kV may be relative to a cathode at −150 kV. Thus, the absolute voltage may be −140 kV relative to a ground.

Figure 1B:
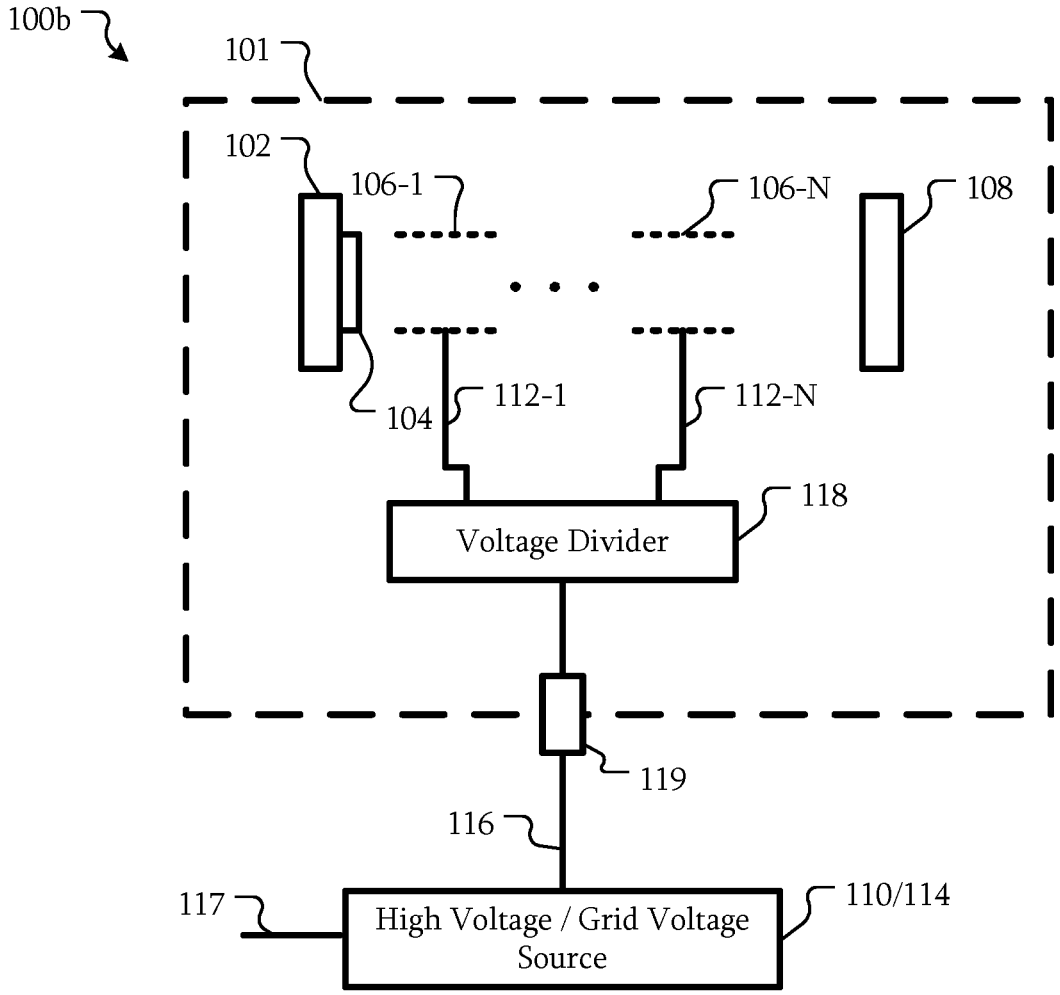

Referring to FIG. 1B, in some embodiments, an electron gun 100*b* may be similar to the electron gun 100*a* of FIG. 1A. However, in this embodiment, the high voltage source 110 and the grid voltage source 114 are combined into a high voltage/grid voltage source 110/114. Using the voltage divider 118 to generate the grid voltages 112 allows the increase in size of the combined high voltage/grid voltage source 110/114 to be smaller as less electronics may be added to the high voltage source 110 to generate a single common grid voltage 116 in contrast to electronics to generate multiple grid voltages.

Figure 1C:
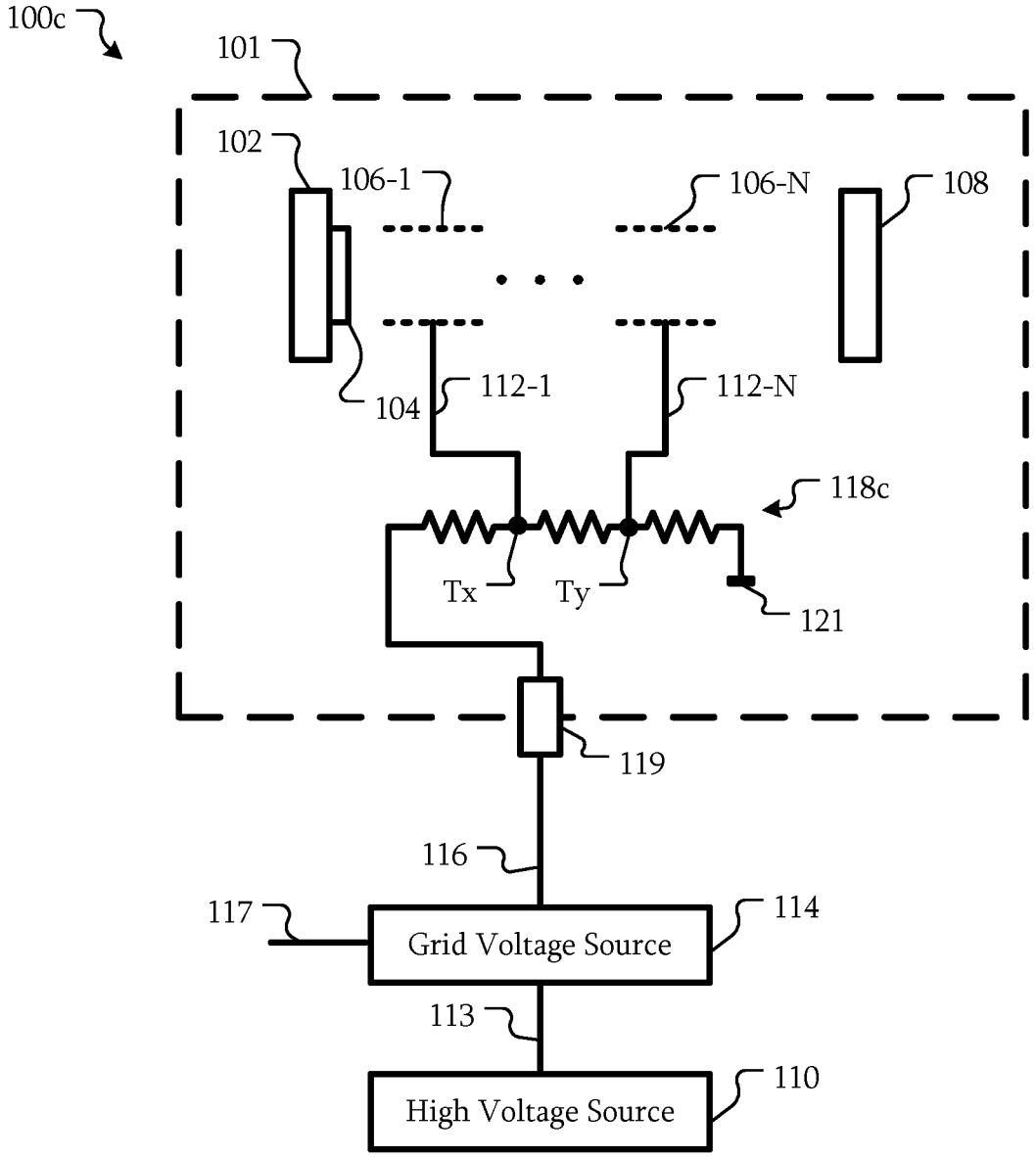

Referring to FIG. 1C, in some embodiments, an electron gun 100*c* may be similar to the electron gun 100*a* and/or 100*b* described above. However, in some embodiments, a resistor ladder 118*c* is used as a voltage divider 118. In particular, the resistor ladder 118*c* has multiple taps T represented by taps Tx and Ty. Although two taps Tx and Ty are used as examples, in other embodiments the number and placement of taps T may be different. For example, some taps T may be at the top of the resistor ladder, i.e., at the common grid voltage 116. In other embodiments, some taps T may be at a reference voltage 121. In some embodiments, at least two of the grid voltages 112 are voltages at taps T of the resistor ladder 118*c*.

In some embodiments, each of the taps T may be connected to a single grid 106. Here, grid 106-1 is connected to tap Tx and grid 106-N is connected to tap Ty. In other embodiments, multiple grids 106 may be connected to a single tap T. Although the order of the taps T and the grids 106 match, in other embodiments, the association may be different. Any tap T may be connected to any grid 106.

Figure 1D:
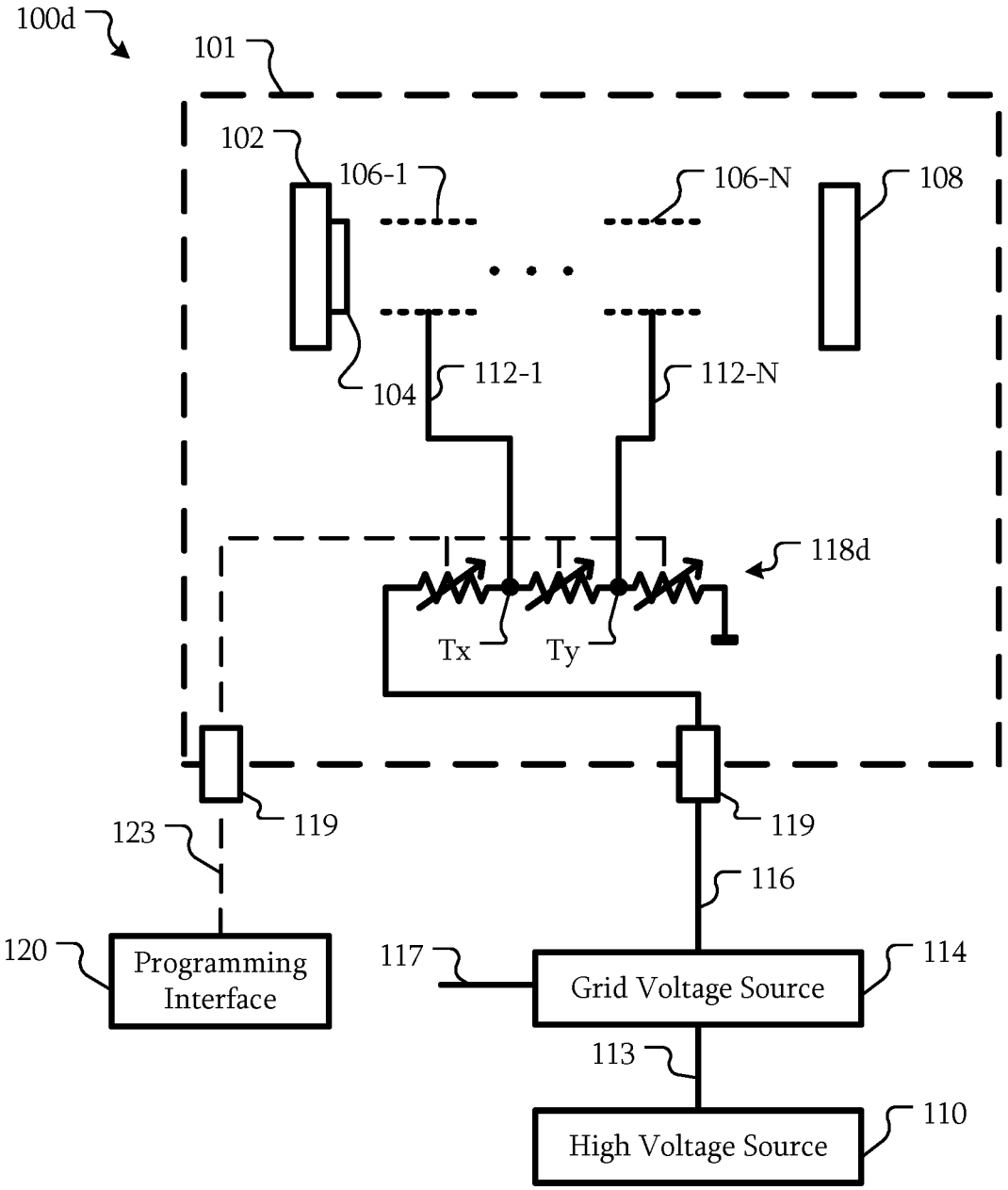

Referring to FIG. 1D, in some embodiments, an electron gun 100*d* may be similar to the electron guns 100*a*, 100*b*, and/or 100*c* described above. However, in some embodiments, the resistor ladder 118*d* includes at least one variable resistor. In this example, each of the resistors is variable; however, in other embodiments, less than all of the resistors of the resistor ladder 118*d* are variable.

Using the variable resistors, each of the voltages at the taps T may be varied not only through varying the common grid voltage 116, the voltages at the taps T, but also through setting the resistance of one or more resistors of the resistor ladder 118*d*. In one example, one or more of the variable resistors may be a potentiometer. In another example, a programming interface 120 may be disposed outside of the high voltage enclosure 101. The variable resistors may be programmable resistors. The programming interface may be circuitry that is configured to interface with one or more variable resistor of the resistor ladder 118*d* using a control signal 123. By programming the resistors, the ratios of the grid voltages 112 to the common grid voltage 116 may be changed.

The control signal 123 may penetrate the high voltage enclosure 101 through a feedthrough 119 similar to the feed through 119 for the common grid voltage 116. However, in other embodiments, different techniques may be used to communicate through the high voltage enclosure 101, such as by using an opto-isolator.

Figure 1E:
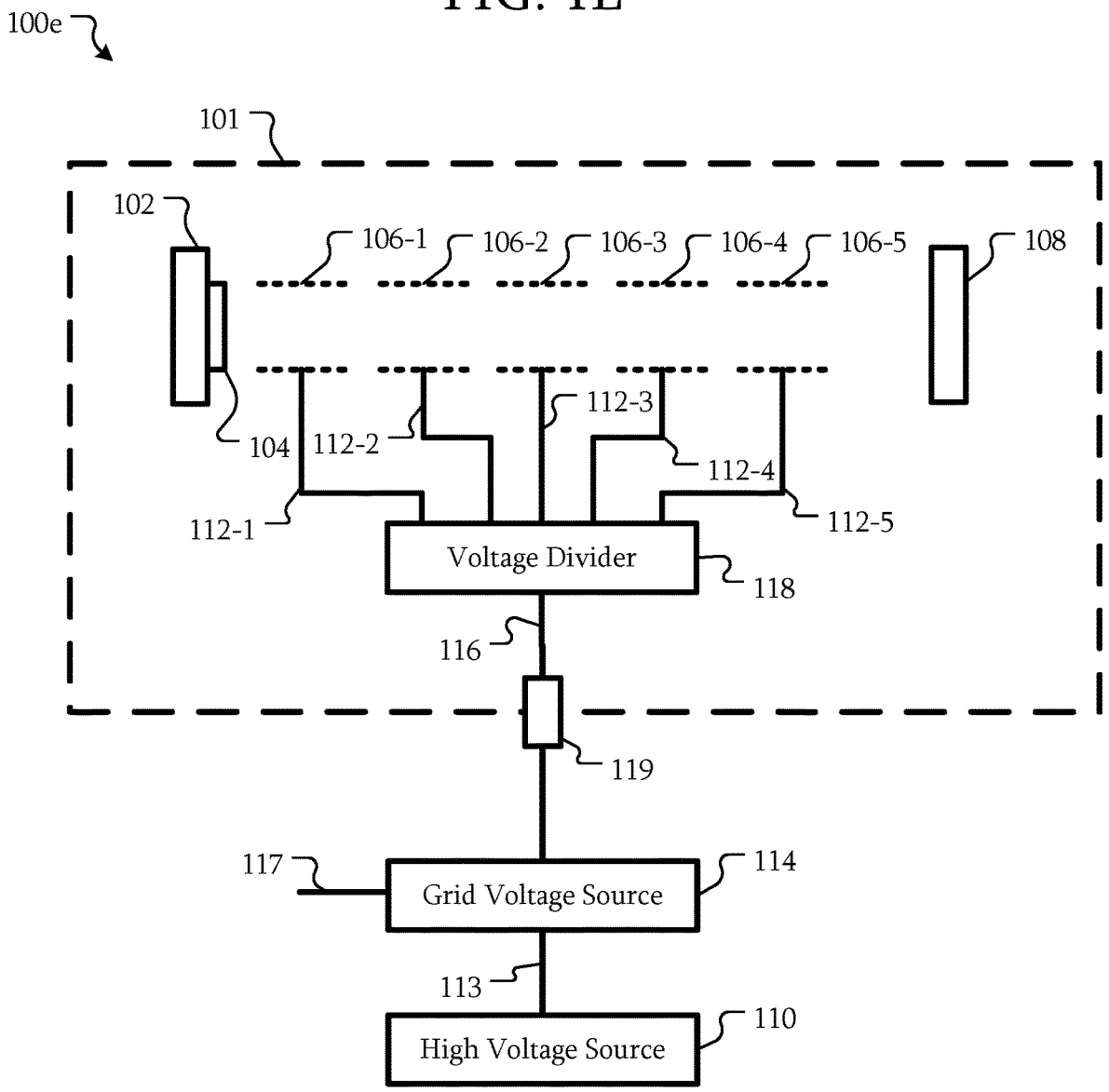

Referring to FIG. 1E, in some embodiments, the electron gun 100*e* is similar to the electron guns 100*a*, 100*b*, 100*c*, and/or 100*d* described above. However, in some embodiments, the electron gun 100*e* includes five grids 106-1 to 106-5. Each of the grids 106-1 to 106-5 is configured to receive a corresponding grid voltage 112-1 to 112-5 from the voltage divider 118.

Figure 1F:
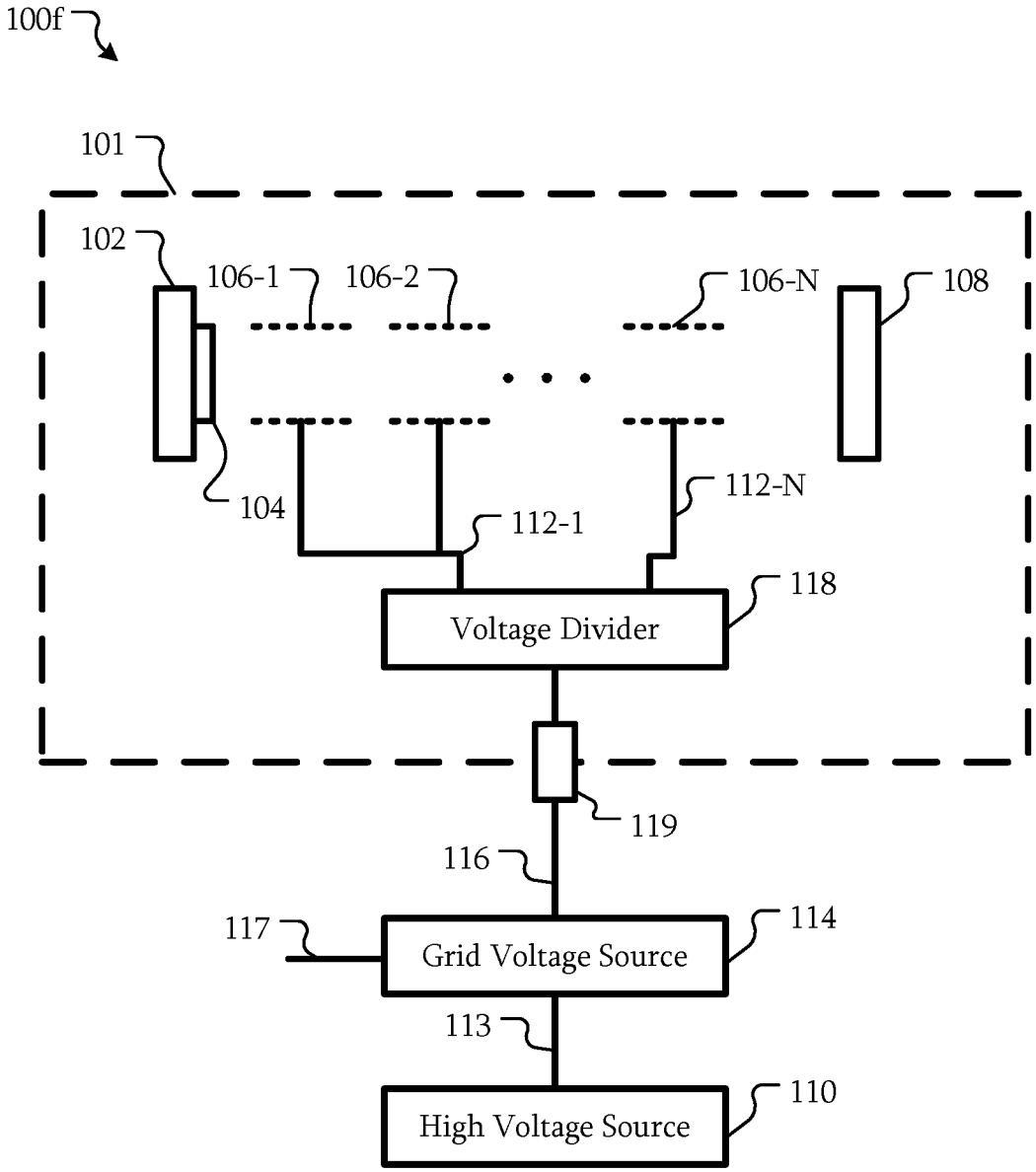

Referring to FIG. 1F, in some embodiments, the electron gun 100*f* is similar to the electron guns 100*a*, 100*b*, 100*c*, 100*d*, and/or 100*e* described above. However, in some embodiments, the voltage divider 118 is configured to apply the same grid voltage 112 to at least two of the grids 106. In this example, the voltage divider 118 is configured to apply the grid voltage 112-1 to both grids 106-1 and 106-2. Although in this example the same grid voltage 112-1 has been illustrated as being applied to adjacent grids 106, in other embodiments, the grids 106 to which the same grid voltage 112-1 is applied by the voltage divider 118 may be any of the grids 106.

Figure 1G:
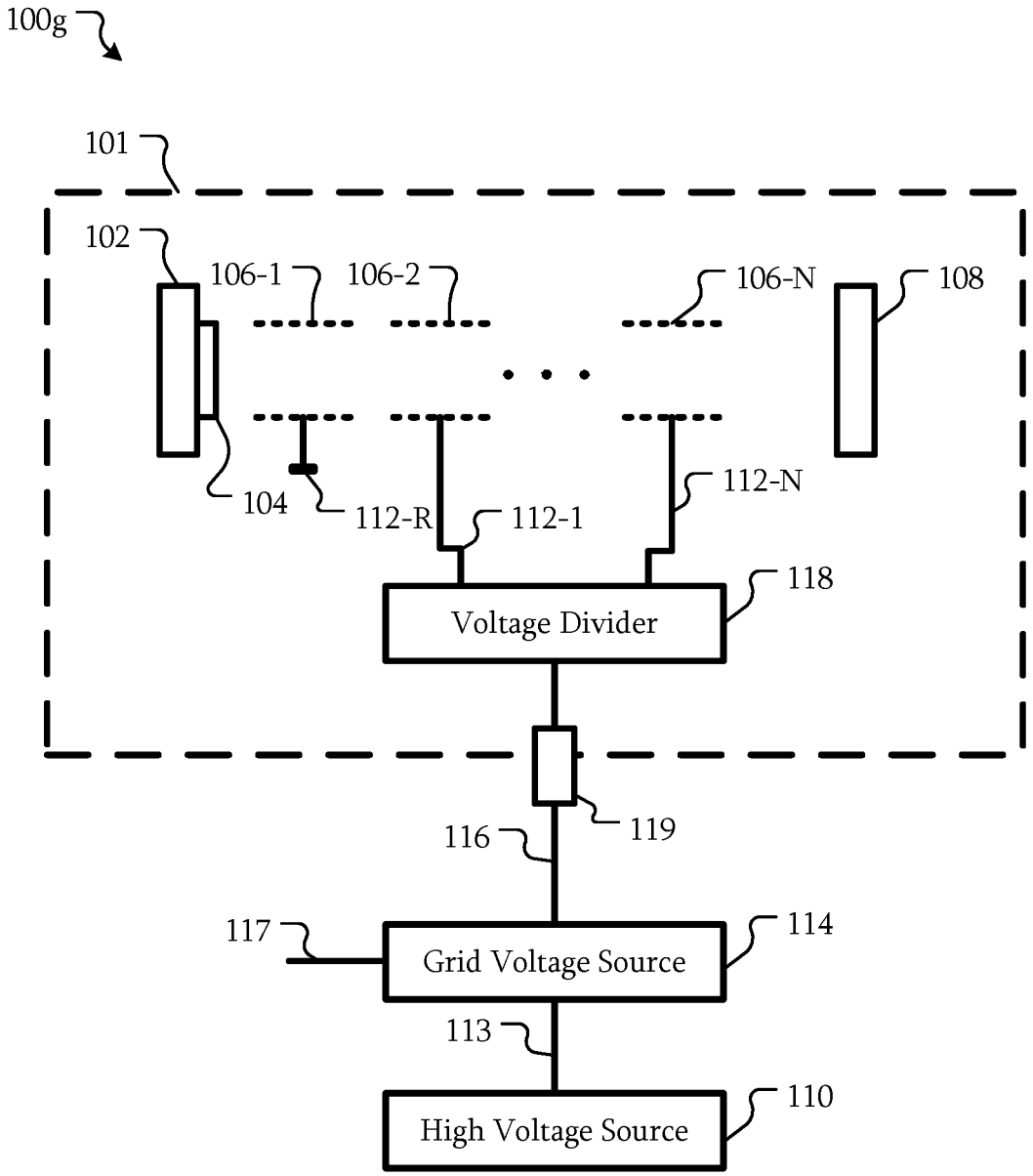

Referring to FIG. 1G, in some embodiments, the electron gun 100*g* is similar to the electron guns 100*a*, 100*b*, 100*c*, 100*d*, 100*e*, and/or 100*f* described above. However, in some embodiments, at least one of the grids 106 is electrically connected to a reference voltage 112-R. Here, one grid 106-1 is electrically connected to a reference voltage 112-R. The reference voltage may be any fixed voltage, such as a cathode voltage, an anode voltage, a ground voltage, or the like. Although a single grid 106-1 is illustrated as being connected to a reference voltage 112-R, in other embodiments, multiple grids 106 may be connected to the reference voltage 112-R. In some embodiments, one or more other grids 106 may be connected to a different reference voltage. That is, multiple grids 106 may be connected to multiple different reference voltages.

Figure 1H:
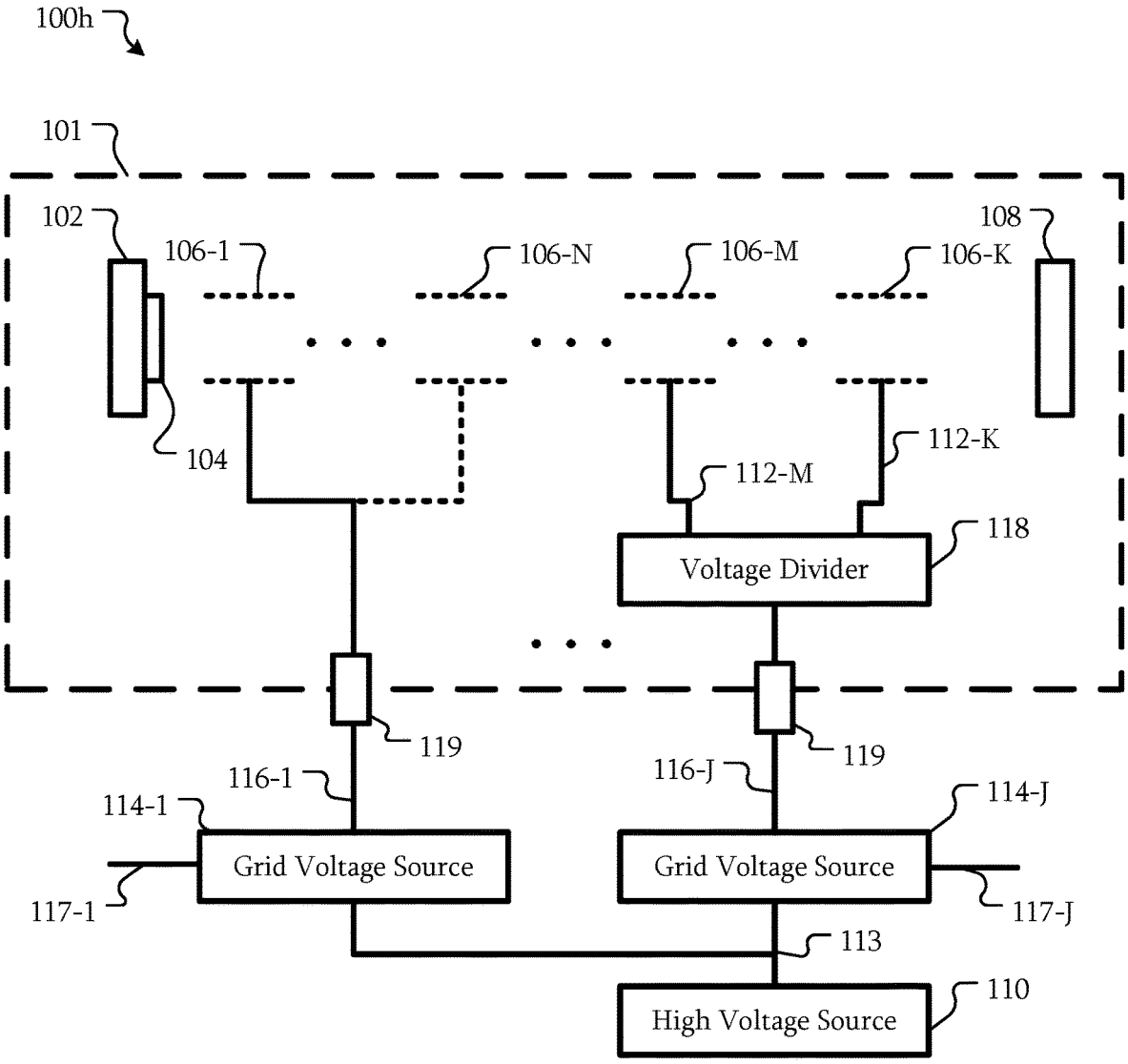

Referring to FIG. 1H, in some embodiments, the electron gun 100*h* is similar to the electron guns 100*a*, 100*b*, 100*c*, 100*d*, 100*e*, 100*f*, and/or 100*g* described above. However, in some embodiments, the electron gun 100*h* is coupled to multiple grid voltage sources 114. Here J grid voltage sources 114 are used as an example, where J is an integer greater than one.

Each of the grid voltage sources 114 is configured to receive the high voltage 113 and generate a corresponding common grid voltage 116 in response. The common grid voltages 116 may be supplied into the high voltage enclosure 101 through the feedthrough 119; however, in other embodiments, a separate feedthrough may be used for one or more of the common grid voltages 116. For grid voltage source 114-1, the common grid voltage 116-1 is applied to one or more grids 106-1 to 106-N where N is an integer greater than or equal to one. In some embodiments, the common grid voltage 116-1 is directly applied to the grids 106-1 to 106-N.

The grid voltage source 114-J is configured to generate the common grid voltage 116-J. The voltage divider 118 is configured to generate grid voltages 112-M to 112-K for grids 106-M to 106-K where M and K are integers and M is less than K. In other words, the voltage divider 118 is configured to generate at least two grid voltages 112 based on the common grid voltage 116-J and apply those grid voltages 112 to corresponding grids 106.

Accordingly, while some grids 106 may receive a grid voltage 112 that was generated based on a common grid voltage 116, other grids 106 may have another common grid voltage 116 directly applied to those grids 106.

Figure 1I:
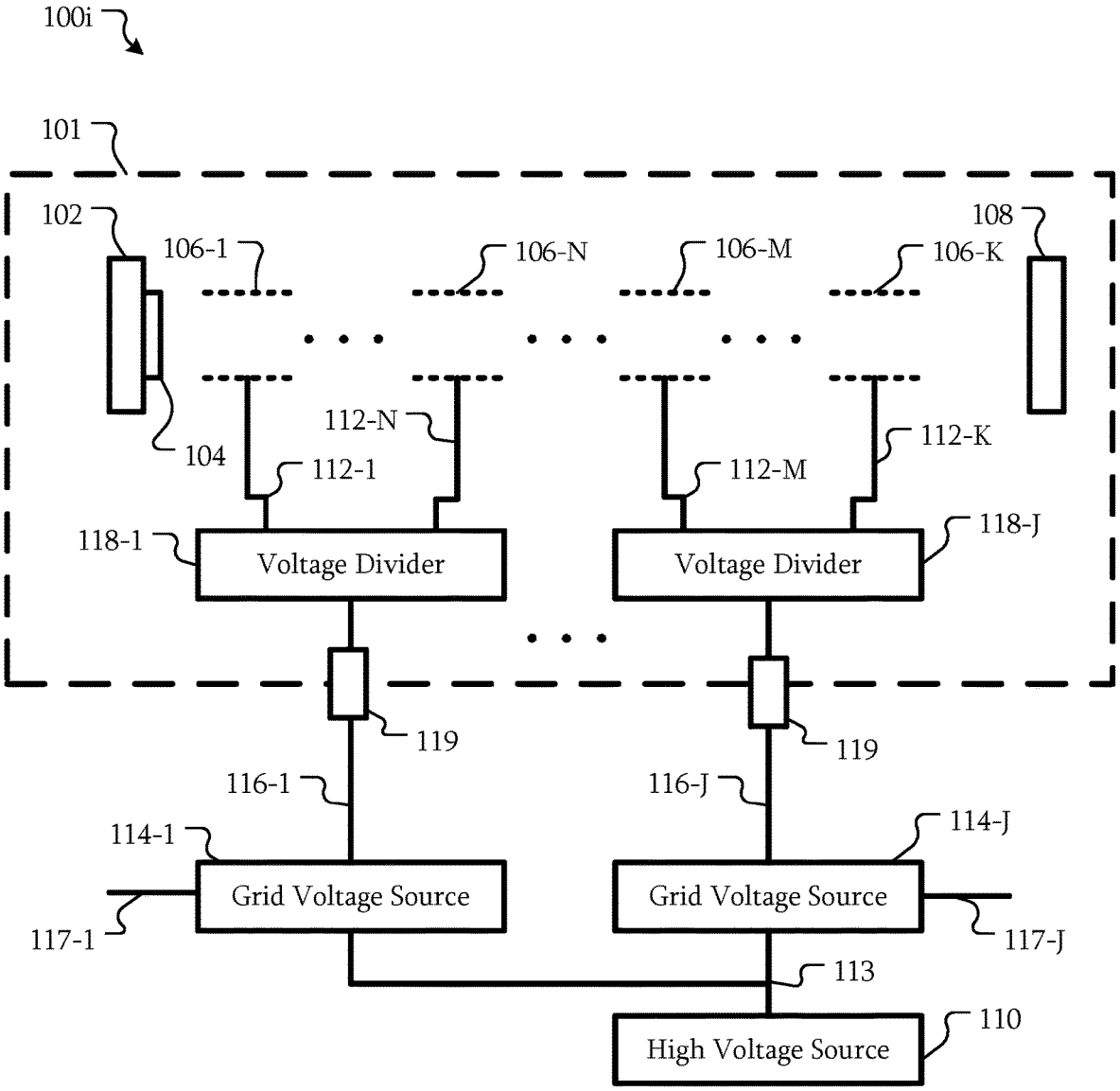

Referring to FIG. 1I, in some embodiments, the electron gun 100*i* is similar to the electron guns 100*a*, 100*b*, 100*c*, 100*d*, 100*e*, 100*f*, 100*g*, and/or 100*h* described above. However, in some embodiments, the electron gun 100*i* is coupled to J grid voltage sources 114-1 to 114-J. Each of the common grid voltages 116-1 to 116-J is received by a corresponding voltage divider 118-1 to 118-J. Each of those voltage dividers 118 is configured to generate at least two grid voltages 112 and apply those to the corresponding grids 106.

In some embodiments, the voltage dividers 118 may be coupled to the same reference voltage. However, in other embodiments, the voltage dividers 118 may use different reference voltages. As a result, the range over which the grid voltages 112 from the different voltage dividers 118 change for a changing common grid voltage 116. For example, as described above, a change in one common grid voltage 116-1 from 10 kV to 5 kV may result in some grid voltages 112 changing from 10 kV and 5 kV to 5 kV and 2.5 kV, respectively. However, with a reference voltage of 10 kV and a common grid voltage 116-J changing from 10 kV to 5 kV, the resulting grid voltages may change from 10 kV and 10 kV to 5 kV and 7.5 kV, respectively.

Figure 2:
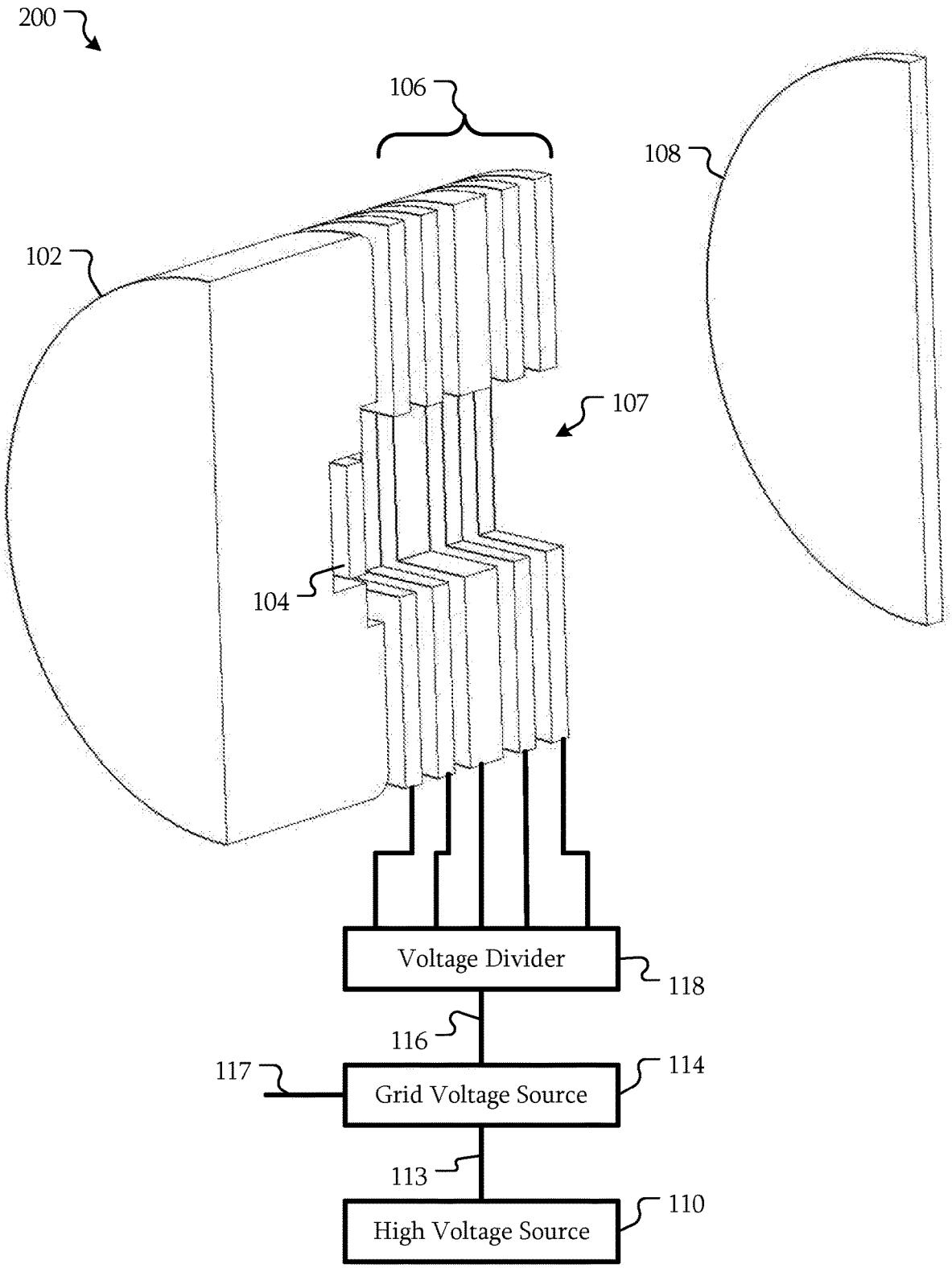
FIG. 2 is a cross-sectional view of an electron gun according to some embodiments.

FIG. 2 is a cross-sectional view of an electron gun according to some embodiments. In some embodiments, an electron gun 200 includes a cathode 102, emitter 104, grids 106, and anode 108. The emitter 104 is a rectangular planar emitter. The grids 106 have corresponding rectangular openings 107.

As illustrated, some of the grids 106 may have different thicknesses. In addition, the grids may be spaced at equal or unequal intervals. In some embodiments, the geometry and positions of the grids 106 may be selected to create a laminar electron beam over an operating range when the grid voltages are ratios of one or more common grid voltages.

Figure 3:
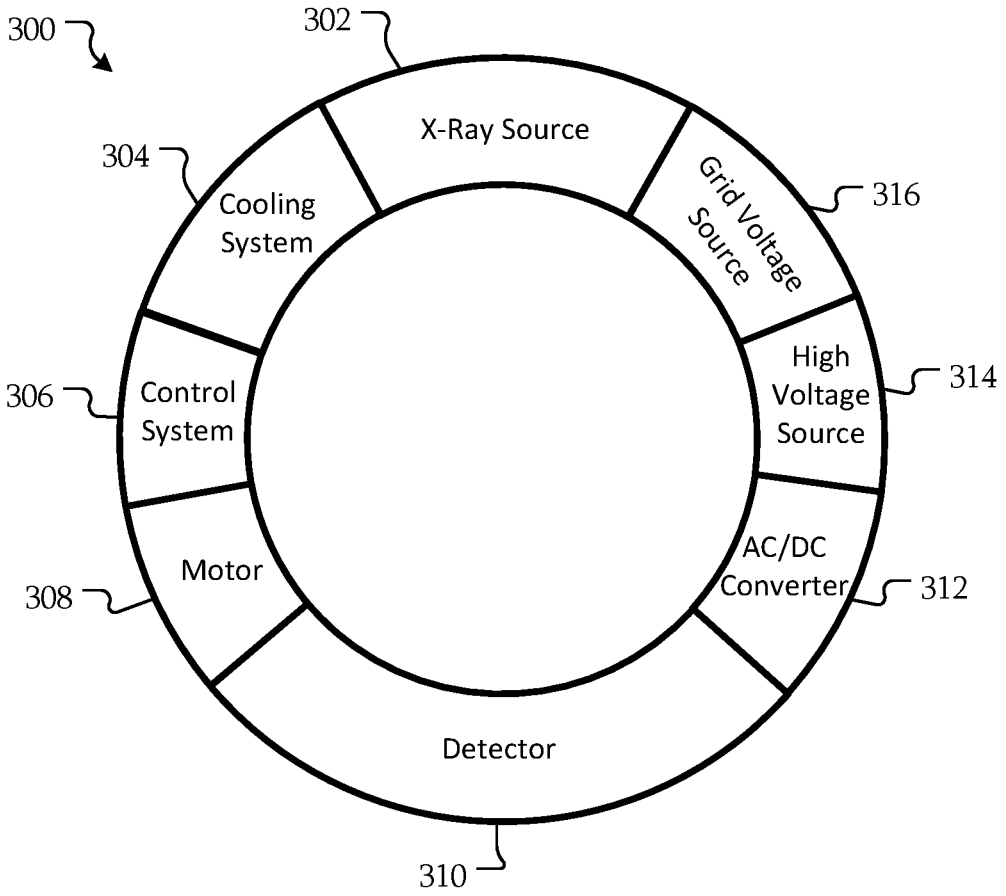
FIG. 3 is a block diagram of a computerized tomography (CT) gantry according to some embodiments.

FIG. 3 is a block diagram of a computerized tomography (CT) gantry according to some embodiments. In some embodiments, the CT gantry includes an x-ray source 302, a cooling system 304, a control system 306, a motor drive 308, a detector 310, an AC/DC converter 312, a high voltage source 314, and a grid voltage source 316. Although particular components have been used as examples of components that may be mounted on a CT gantry in addition to the x-ray source 302, high voltage source 314, and grid voltage source 316, in other embodiments, the other components may be different.

Regardless, the space on the CT gantry 300 may be fully consumed by the additional components, As a result, space for an additional grid voltage source 316 may not be available. However, by using x-ray source 302 with an electron gun as described herein, a single grid voltage source 316 may be divided into multiple grid voltages within a high voltage enclosure of the x-ray source 302.

Referring to FIGS. 1A-1I, some embodiments include a system, comprising: a high voltage enclosure 101; a cathode 102 disposed in the high voltage enclosure 101; an anode 108 disposed in the high voltage enclosure 101; a plurality of grids 106 disposed in the high voltage enclosure 101 between the cathode 102 and the anode 108; a voltage source 114 configured to generate a common grid voltage 116; and a voltage divider 118 disposed in the high voltage enclosure 101, configured to generate a plurality of grid voltages 112 based on the common grid voltage 116, and configured to apply at least two of the grid voltages 112 to the grids 106.

In some embodiments, the voltage source 114 is a variable voltage source 114.

In some embodiments, the voltage divider 118 is a resistor ladder 118*c*; and the at least two of the grid voltages 112 are voltages at taps T of the resistor ladder 118*c*.

In some embodiments, at least one resistor of the resistor ladder 118*d* is a variable resistor.

In some embodiments, the at least one of the grid voltages 112 is the common grid voltage 116.

In some embodiments, the voltage divider 118 is configured to apply one of the grid voltages 112 to at least two of the grids 106.

In some embodiments, the system further comprises a second voltage source 114 configured to generate a second common grid voltage 116; and a second voltage divider 118 disposed in the high voltage enclosure 101, configured to generate a plurality of second grid voltages 112 based on the second common grid voltage 116, and configured to apply at least two of the second grid voltages 112 to the grids 106.

In some embodiments, the system further comprises a second voltage source 114; wherein at least one of the grids 106 is electrically connected to the second voltage source 114.

In some embodiments, at least one of the grids 106 is electrically connected to a reference voltage.

In some embodiments, the system further comprises a computerized tomography (CT) gantry 300; wherein the high voltage enclosure 101 and the voltage source 114 are disposed on the CT gantry 300.

Some embodiments include a method, comprising: generating a common grid voltage 116 by a voltage source 114; dividing the common grid voltage 116 into a plurality of grid voltages 112 within a high voltage enclosure 101 of an electron gun 100; and applying the grid voltages 112 to a plurality of grids 106 within the high voltage enclosure 101.

In some embodiments the method further comprises proportionally changing the grid voltages 112 in response to a change in the common grid voltage 116.

In some embodiments, generating the common grid voltage 116 comprises generating the common grid voltage 116 outside of the high voltage enclosure 101.

In some embodiments, the at least one of the grid voltages 112 is the common grid voltage 116.

In some embodiments, applying the grid voltages 112 to the grids 106 comprises applying one of the grid voltages 112 to at least two of the grids 106.

In some embodiments the method further comprises generating a second common grid voltage 116; and dividing the second common grid voltage 116 into a plurality of second grid voltages 112 within a high voltage enclosure 101; and applying the second grid voltages 112 to the grids 106.

In some embodiments the method further comprises applying a reference voltage to at least one of the grids 106.

Examples of the means for emitting electrons include the emitter 104

Examples of the means for controlling a flow of the electrons include the grids 106

Examples of the means for generating a common voltage include the grid voltage source 114. Examples of the means for generating a second voltage include the grid voltage source 114.

Examples of the means for generating a plurality of control voltages based on the common voltage include the voltage divider 118. Examples of the means for generating a plurality of second control voltages based on the second common voltage include the voltage divider 118.

Examples of the means for resistively dividing the common voltage include the resistor ladders 118*c* and 118*d*.

Examples of the means for applying the control voltages to the plurality of means for controlling the flow of the electrons include the connections between the voltage divider 118 and the grids 106. Examples of the means for applying the second control voltages to the plurality of means for controlling the flow of the electrons include the connections between the voltage divider 118 and the grids 106.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112 ¶6. Embodiments of the invention in which an exclusive property or privilege is claimed are defined as follows.

The invention claimed is:

1. A system, comprising:

a high voltage enclosure of an electron gun;

a cathode of the electron gun disposed in the high voltage enclosure;

an anode of the electron gun disposed in the high voltage enclosure;

a plurality of grids of the electron gun disposed in the high voltage enclosure between the cathode and the anode;

a voltage source configured to generate a common grid voltage; and a voltage divider disposed in the high voltage enclosure, configured to generate a plurality of grid voltages based on the common grid voltage, and configured to apply at least two of the grid voltages to the grids.

2. The system of claim 1, wherein the voltage source is a variable voltage source.

3. The system of claim 1, wherein:

the voltage divider is a resistor ladder; and the at least two of the grid voltages are voltages at taps of the resistor ladder.

4. The system of claim 3, further comprising:

a feedthrough penetrating the high voltage enclosure;

wherein:

at least one resistor of the resistor ladder is a variable resistor; and the variable resistor is configured to receive a control signal through the feedthrough.

5. The system of claim 1, wherein at least one of the grid voltages is the common grid voltage.

6. The system of claim 1, wherein the voltage divider is configured to apply one of the grid voltages to at least two of the grids.

7. The system of claim 1, further comprising:

a second voltage source configured to generate a second common grid voltage; and a second voltage divider disposed in the high voltage enclosure, configured to generate a plurality of second grid voltages based on the second common grid voltage, and configured to apply at least two of the second grid voltages to the grids.

8. The system of claim 1, further comprising:

a second voltage source;

wherein at least one of the grids is electrically connected to the second voltage source.

9. The system of claim 1, wherein at least one of the grids is electrically connected to a reference voltage.

10. The system of claim 1, further comprising:

a computerized tomography (CT) gantry;

wherein the high voltage enclosure and the voltage source are disposed on the CT gantry.

11. The system of claim 1, wherein the common grid voltage is independent of an anode voltage of the anode.

12. A method, comprising:

generating a common grid voltage by a voltage source;

dividing the common grid voltage into a plurality of grid voltages within a high voltage enclosure of an electron gun; and applying the grid voltages to a plurality of grids within the high voltage enclosure.

13. The method of claim 12, further comprising proportionally changing the grid voltages in response to a change in the common grid voltage.

14. The method of claim 12, wherein generating the common grid voltage comprises generating the common grid voltage outside of the high voltage enclosure.

15. The method of claim 12, wherein the at least one of the grid voltages is the common grid voltage.

16. The method of claim 12, wherein applying the grid voltages to the grids comprises applying one of the grid voltages to at least two of the grids.

17. The method of claim 12, further comprising:

generating a second common grid voltage; and dividing the second common grid voltage into a plurality of second grid voltages within a high voltage enclosure; and applying the second grid voltages to the grids.

18. The method of claim 12, further comprising applying a reference voltage to at least one of the grids.

19. A system, comprising:

means for emitting electrons disposed in a high voltage enclosure;

a plurality of means for controlling a flow of the electrons disposed in the high voltage enclosure;

means for generating a common voltage;

means for generating a plurality of control voltages based on the common voltage disposed in the high voltage enclosure; and means for applying the control voltages to the plurality of means for controlling the flow of the electrons.

20. The system of claim 19, wherein the means for generating the control voltages includes means for resistively dividing the common voltage.

21. The system of claim 19, further comprising:

means for generating a second voltage;

means for generating a plurality of second control voltages based on the second common voltage disposed in the high voltage enclosure; and means for applying the second control voltages to the plurality of means for controlling the flow of the electrons.

* * * * *